US005899823A

United States Patent [19]

Eggiman

[11] Patent Number: 5,899,823

[45] Date of Patent: May 4, 1999

[54] BALL BAT WITH INSERT

[75] Inventor: Michael D. Eggiman, Hillsboro, Oreg.

[73] Assignee: DeMarini Sports, Inc., Hillsboro, Oreg.

[21] Appl. No.: 08/921,628

[22] Filed: Aug. 27, 1997

[51] Int. Cl.[6] ..... A63B 59/06

[52] U.S. Cl. ..... 473/566

[58] Field of Search ..... 473/564, 566, 473/567, 520

[56] References Cited

U.S. PATENT DOCUMENTS

| | | |
|---|---|---|
| 2,379,006 | 6/1945 | Johnson . |
| 3,116,926 | 1/1964 | Owen et al. . |
| 3,727,295 | 4/1973 | Gildemeister . |
| 3,801,098 | 4/1974 | Gildemeister . |
| 3,811,596 | 5/1974 | Wilson . |
| 3,830,496 | 8/1974 | Reizer . |
| 3,861,682 | 1/1975 | Fujii . |
| 3,876,204 | 4/1975 | Moore et al. . |
| 3,963,239 | 6/1976 | Fujii . |
| 3,972,528 | 8/1976 | McCracken et al. . |
| 4,056,267 | 11/1977 | Krieger . |
| 4,113,248 | 9/1978 | Yanagioka . |
| 4,351,786 | 9/1982 | Mueller . |
| 4,569,521 | 2/1986 | Mueller . |
| 4,600,193 | 7/1986 | Merritt . |
| 4,951,948 | 8/1990 | Peng . |
| 4,961,576 | 10/1990 | Meredith . |
| 5,094,453 | 3/1992 | Douglas et al. . |
| 5,104,123 | 4/1992 | Okitsu et al. . |
| 5,114,144 | 5/1992 | Baum . |
| 5,131,651 | 7/1992 | You . |
| 5,180,163 | 1/1993 | Lanctot . |
| 5,219,164 | 6/1993 | Peng . |
| 5,393,055 | 2/1995 | MacKay, Jr. . |
| 5,415,398 | 5/1995 | Eggiman . |
| 5,511,777 | 4/1996 | McNeely . |

FOREIGN PATENT DOCUMENTS

| | | |
|---|---|---|
| 4-303477 | 10/1992 | Japan . |
| 5-23407 | 2/1993 | Japan . |
| 2247932 | 3/1992 | United Kingdom . |

*Primary Examiner*—Mark S. Graham
*Attorney, Agent, or Firm*—Klarquist Sparkman Campbell Leigh & Whinston, LLP

[57] ABSTRACT

A tubular ball bat with a performance enhancing sleeve is disclosed wherein the sleeve has improvements for better manufacturability and performance. The insert is provided with a deformable end that can be forced into a tapered portion of a bat to easily and securely couple that end of the insert to the inner surface of the bat.

7 Claims, 1 Drawing Sheet

BALL BAT WITH INSERT

BACKGROUND OF THE INVENTION

1. Field of the Invention

This invention pertains to ball bats used, for example, in baseball and softball. More particularly, this invention pertains to tubular ball bats made of metal, such as aluminum.

2. Description of the Related Art

Recent years have seen an emergence of tubular, metal ball bats for use in ball sports, such as softball and baseball. Some of the tubular bats have objects located in the hollow core to improve various aspects of bat performance. Some manufacturers place rebound cores in the bats such as those shown in U.S. Pat. No. 5,511,777. This patent discloses a rebound core that is mounted in a tubular bat in order to dampen the sound and vibration caused by the impact between the bat and ball.

Other manufacturers place inserts in the bat to improve batting performance. See U.S. Pat. No. 5,415,398. This patent discloses an insert in the shape of a tubular sleeve that is mounted inside the tubular frame, within the impact portion of the bat. The sleeve is fixedly coupled at its distal ends to the bat, while its mid-portion is slightly separated radially from the surrounding impact portion of the bat.

While the sleeve insert of the '398 patent has been shown to improve hitting capacity, it is desired to improve the manufacturability of the bat so that the design is easier to manufacture, has better quality control, and other improved characteristics.

SUMMARY OF THE INVENTION

The present invention provides improvements to the above-described art by providing a tubular sleeve insert for tubular ball bats, wherein the insert includes a resilient coupling portion that can resiliently, yet fixedly engage an inside surface of the bat. In one embodiment, the resilient coupling comprises a plurality of fingers cut into an end of the tubular sleeve so that they can easily deform to conform to the inside surface of the tubular ball bat.

The process, and insert structure, described herein are distinguished from the prior art wherein a tubular insert is forced into a tubular bat frame. In the prior art the insert material simply terminates at circular cross section ends. When the prior art insert end is forced into a tapered cavity the insert end jams against the cavity and may fictionally engage the walls of the cavity. Because prior tubular bats are made of metal, and because metal expands in tension more easily than it compresses, the prior insert does not resiliently engage the tapered cavity. Instead, the tubular bat frame is more likely to expand when the prior art insert is forced against the inner tapered midsection of the bat frame, thus deforming the bat frame and possibly weakening its structure.

Various advantages and features of novelty which characterize the invention are particularized in the claims forming a part hereof. However, for a better understanding of the invention and its advantages, reference should be had to the drawings and to the accompanying description in which there is illustrated and described preferred embodiments of the invention.

DETAILED DESCRIPTION OF THE PREFERRED EMBODIMENTS

Figure 1:
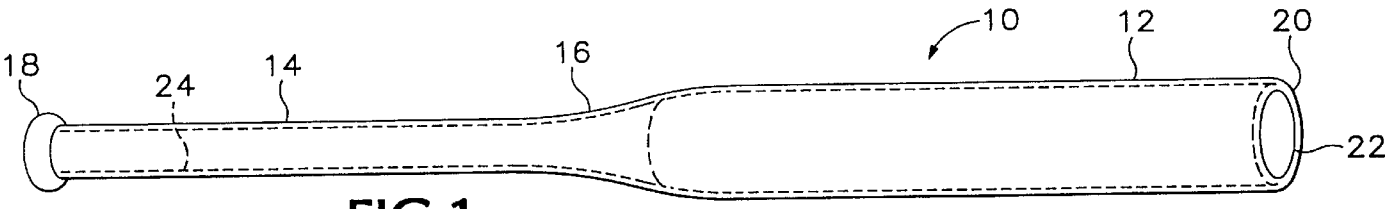
FIG. 1 is a perspective view of a ball bat showing an insert in phantom lines located within an impact portion of the bat.

Referring to FIG. 1, there is shown a tubular ball bat 10 having an impact portion 12, a handle portion 14, and a tapered transition portion 16 that extends between the handle and impact portions. Preferably, the impact portion 12 and the handle portion 14 are elongate, cylindrical shapes and collinear with one another. The impact portion 12 has a larger diameter than the handle portion 14. The transition portion 16 joins the impact portion 12 and handle portion 14 and accordingly tapers in diameter from one end to the other. A knob 18 is provided at one end of the handle portion.

As shown in the figures, a distal end 20 of the impact portion 12 is open to facilitate the manufacture of the bat. However, in actual use the end will be closed by a plug (not shown).

As noted, the ball bat 10 shown and described herein, is a tubular structure, having a hollow interior or interior cavity 22 that extends the entire length of the bat. The cavity is defined by an inner surface 24 of the tubular structure.

Figure 2:
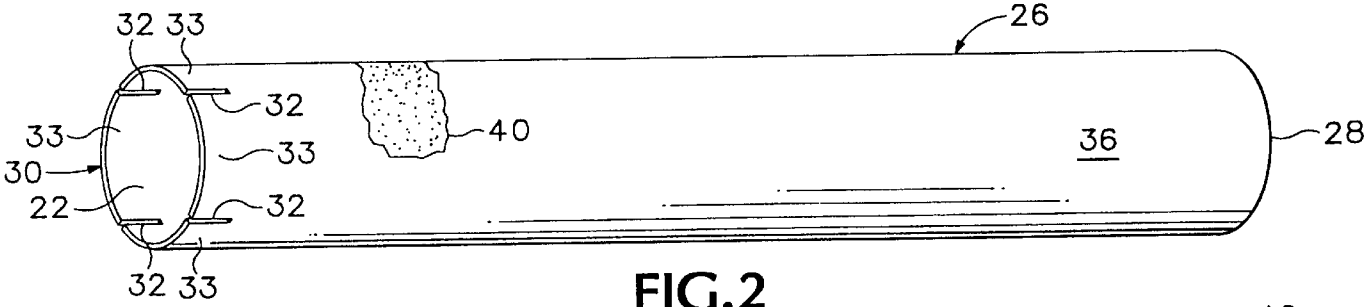
FIG. 2 is an enlarged perspective view of a sleeve insert in accordance with the present invention.

As shown in FIG. 2, an insert 26 preferably takes the form of a tubular sleeve having a substantially circular cross-section. The insert 26 has a first end 28 and a second end 30 that is resiliently deformable so that the insert 26 can conform to the inner surface 24 of the bat in the manner described below.

In a preferred embodiment, the second end 30 is made resiliently deformable by providing a plurality of slits 32 that extend longitudinally from the end 30. Preferably, the slits 32 extend for approximately one-half inch for inserts used in standard ball bat sizes for adults. In the illustrated embodiment, there are four slits 32 located in equally-spaced arrangement about the circumference of the end 30, thereby forming four tabs or fingers 33 between the slits. The slits 32 define spaces between adjacent fingers 33.

One of the benefits of the present invention is its improved manufacturability for tubular bats having an insert such as disclosed herein. A portion of the manufacturing process will now be described.

The entire outer wall of the insert 26 preferably is coated with a lubricant such as a high-temperature grease and then inserted into the distal end 20 of the ball bat 10. The insert slides easily within the bat since the outer diameter of the insert is about 0.01 inch less than the inner diameter of the bat's impact portion 12. As the insert is pushed into the bat, some grease may be wiped away. However, some grease remains and the insert 26 is substantially coated along its outer exterior surface 36 when it is fully inserted in the bat.

One variant of this step is to apply grease to a main body of the insert but not to the deformable end portion comprising fingers 33. This variation creates a mechanically stiffer bat which may be advantageous in some contexts. Another variant is to install the insert without the use of grease. The presence of grease or comparable lubricant is not critical. It is important however to permit or facilitate relative siding movement between the outer wall of the insert and inner wall of the bat. For example, relative friction between the insert and bat also can be minimized or at least reduced by anodizing the exterior surface 36 of the insert before insertion, polishing the exterior surface 36, or coating the insert with other lubricating materials besides grease (so long as the coating(s) do not fixedly adhere the insert to the inner surface 24 along its length). Other alternative lubricants and ways to facilitate such relative movement are described in U.S. Pat. No. 5,415,398 which is incorporated herein by reference.

Figure 4:
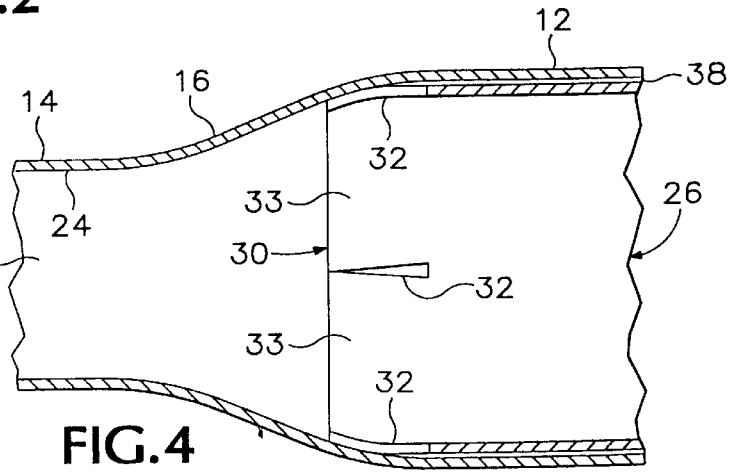
FIG. 4 is an enlarged cross-section view, as in FIG. 3, showing the insert fully installed in the bat.
Figure 3:
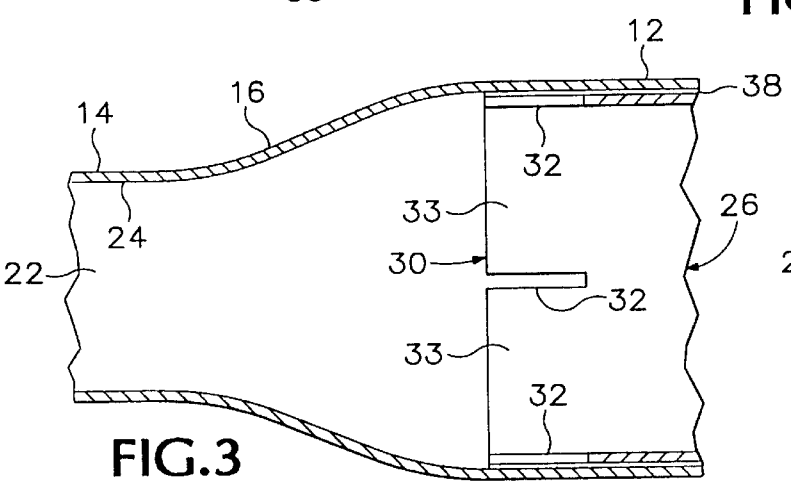
FIG. 3 is an enlarged cross-sectional view of a portion of the bat showing the insert as it is being installed in the bat.

Once the insert is fully prepared (as, for example, by coating the exterior surface with grease), it is pushed into the impact portion 12. The insert does not deform until it contacts the interior surface of the tapered transition portion 16. The insert 26 is then wedged further into the bat so that the end 30 is forced into the tapered section 16, as shown in FIG. 4. This causes the fingers 33 to deform radially inward and at least partially close off ends of the slits 32. The exterior surface of the fingers also conform to the inner surface 24 of the transition portion 16.

The insert is not forced into the tapered portion so hard as to create a press or interference fit. Upon ball impact, some relative movement between the fingers and ball bat is desirable. The desired wedge fit can be obtained by, for example, inserting the insert into the open end of the ball bat and tapping the bat handle three or four times on a steel plate on the ground to seat or wedge the insert fingers in the tapered transition portion of the bat.

Because the diameter of the insert is slightly less than the inner diameter of the impact portion 12, a small gap 38 is formed between the outer surface 36 of the insert and the inner surface 24 of the impact portion. In a preferred form of the invention, the outer diameter of the insert is about 0.213 inch and inner diameter of the bat impact portion is about 0.215, creating a gap of about 0.01 inch therebetween. When grease is used, it substantially fills the gap 38, although there may be voids or air pockets.

Because of the resilient nature of the insert, due to the deformation of the fingers, the second end 30 becomes wedged in the tapered transition portion. However, even with the end plug (not shown) in place, the second end 30 of the insert has greater capacity to move relative to the surrounding wall due to the resilient nature of the fingers (as compared to an insert lacking fingers). Upon ball impact, the portion of the insert nearest the impact zone deflects inwardly to give the deflected area a radius of curvature, thereby causing the fingers to retract away from the bat handle. Following impact the resilient fingers reseat themselves to their original position. Thus, the greatest penetration of the fingers into the tapered portion is when the bat is static (i.e., no impact).

At the distal end 20 the insert 26 may terminate at the same length as the impact portion 12 or somewhat short of the end 20. In the preferred embodiments of the bat, the bat end 20 is swaged over, causing the bat to constrict upon the insert 26 to couple the insert end 28 to the bat at end 20. Alternatively, the bat end may be pinched inwardly by using a press with a curl die or other known manufacturing techniques.

Due to tolerances in the manufacturing process, the outer surface 36 of the insert's midsection may contact the inner surface 24 of the bat 10 at random locations throughout its length. Such contact will not prevent the ball bat 10 and the insert 26 from sliding relative to each other when those members deform, for example, upon impact with a ball. The presence of the grease further facilitates relative sliding of those members. This relative sliding is not a feature of the present invention and is known in the prior art. However, it is notable that the method of coupling the insert to the ball bat described herein does not hinder such relative sliding feature or affect the bat performance due to such feature.

Preferably, the insert 26 is made of the same material as the ball bat 10. A popular material for the bat and insert is high-grade aluminum. However, it is not critical to use the same materials.

The fingers 33 permit the insert to readily conform and be fixedly coupled to the surrounding interior bore wall of the tapered transition portion in a way which does not affect the structural integrity of the bat at that point. Without the resiliency provided by the fingers, the step of inserting the insert could adversely weaken the transition portion by causing it to forcibly expand, particularly if the insert is thrust into the cavity beyond the normal limits. Thus, the present invention not only improves the structural integrity and stability of the bat, but provides additional margin for error in the manufacturing process.

Numerous characteristics and advantages of the invention have been set forth in the foregoing description, together with details of the structure and function of the invention. The novel features hereof are pointed out in the appended claims. The disclosure is illustrative only, and changes may be made in detail, especially in matters of shape, size, and arrangement of parts within the principle of the invention to the full extent indicated by the broad general meaning of the terms in the claims.

I claim:

1. A ball bat, comprising:

(a) a tubular member having a first cylindrical portion with a first diameter, a second cylindrical portion with a second diameter smaller than the first diameter and a tapered portion coupled to, and extending between, the first and second cylindrical portions, the tubular member having an interior cavity defined by inner surfaces of the first cylindrical portion and the tapered portion; and (b) a tubular insert located in the interior cavity radially inward of the first cylindrical portion and the tapered portion, the tubular insert having a deformable end that resiliently deforms to conform to the inner surface of the tapered portion thereby coupling the insert to the tubular member;

wherein the insert includes a main body, the deformable end having plural tabs capable of radially inward deformation so as to conform to the inner surface of the tapered portion.

2. A ball bat, comprising:

(a) a tubular member having a first cylindrical portion with a first diameter, a second cylindrical portion with a second diameter smaller than the first diameter and a tapered portion coupled to, and extending between, the first and second cylindrical portions, the tubular member having an interior cavity defined by inner surfaces of the first cylindrical portion and the tapered portion; and (b) a tubular insert located in the interior cavity radially inward of the first cylindrical portion and the tapered portion, the tubular insert having a deformable end that resiliently deforms to conform to the inner surface of the tapered portion thereby coupling the insert to the tubular member;

wherein the deformable end is defined by a plurality of slits that define plural tabs that deform to conform to the inner surface of the tapered portion.

3. A ball bat, comprising:

(a) a tubular member having a first cylindrical portion with a first diameter, a second cylindrical portion with a second diameter smaller than the first diameter and a tapered portion coupled to, and extending between, the first and second cylindrical portions, the tubular member having an interior cavity defined by inner surfaces of the first cylindrical portion and the tapered portion; and (b) a tubular insert located in the interior cavity radially inward of the first cylindrical portion and the tapered portion, the tubular insert having a deformable end that resiliently deforms to conform to the inner surface of the tapered portion thereby coupling the insert to the tubular member;

wherein the deformable end defines four circumferentially spaced slits which define tabs therebetween, the slits creating an interstice between adjacent tabs to allow the tabs to deform into the interstices when the deformable end is press fit into the interior cavity of the tapered portion.

4. The ball bat of claim 3 wherein the first cylindrical portion has first and second ends and the first end adjoins the tapered portion and the second end is swaged to contact the insert and thereby further couple the insert to the tubular member.

5. A ball bat, comprising:

(a) a frame member having a handle portion and a ball impact portion that includes a substantially cylindrical wall defining a hollow interior; and (b) a sleeve located coaxially within the interior, the sleeve having at one end resilient extensions which press resiliently against an inside surface of the cylinder wall to facilitate relative axial movement between the end of the sleeve and cylindrical wall;

wherein the sleeve has a substantially cylindrical body and the resilient extensions are circumferentially spaced tabs located at the end of the body.

6. A ball bat, comprising:

(a) a frame member having a handle portion and a ball impact portion that includes a substantially cylindrical wall defining a hollow interior; and (b) a sleeve located coaxially within the interior, the sleeve having at one end resilient extensions which press resiliently against an inside surface of the cylinder wall to facilitate relative axial movement between the end of the sleeve and cylindrical wall;

wherein the bat further includes a tapered portion located between the ball impact portion and handle portion, the sleeve being located such that the extensions extend at least partially into the tapered portion and resiliently press against the tapered portion.

7. A ball bat comprising:

a tubular member having a ball impact portion of a first diameter, handle portion of a second lessor diameter and tapered transition portion extending therebetween, the tubular member having an inner bore wall which defines an internal cavity; and a sleeve located within the cavity and extending the full length of the ball impact portion, the sleeve having first and second ends, the first end defining a plurality of circumferentially spaced, axially extending slits which define a plurality of tabs therebetween, the tabs extending into and being deformable to conform to the tapered transition portion;

the ball impact portion having an end wall which is curled inwardly to contact the second end of the sleeve, whereby the sleeve is held in place in a manner to permit the sleeve to deform inwardly and move axially relative to the ball impact portion when the ball impact portion is struck by a ball.

* * * * *